United States Patent [19]

Swindler et al.

[11] 4,041,260

[45] Aug. 9, 1977

[54] INTERLOCK FOR CIRCUIT BREAKERS

[75] Inventors: David L. Swindler, Franklin; Donald L. Dykes, Middletown, both of Ohio

[73] Assignee: Square D Company, Park Ridge, Ill.

[21] Appl. No.: 622,284

[22] Filed: Oct. 10, 1975

[51] Int. Cl.[2] ..... H01H 9/20; H01H 3/20

[52] U.S. Cl. ..... 200/50 A; 200/153 R

[58] Field of Search ..... 200/50 A, 50 B, 50 AA, 200/50 C, 51 R, 51.09, 51.14, 153 R, 337

[56] References Cited

U.S. PATENT DOCUMENTS

| | | | |
|---|---|---|---|
| 1,971,990 | 8/1934 | Reynolds et al. | 200/51.09 |
| 2,545,965 | 3/1951 | McCamon | 200/51 R X |
| 3,598,941 | 8/1971 | Nelson | 200/51.09 |

*Primary Examiner*—James R. Scott

*Attorney, Agent, or Firm*—Richard T. Guttman; Norton Lesser

[57] ABSTRACT

A circuit breaker of a medium voltage roll-in type is connected to an external control system by a plug and associated conductor line. The plug has a handle that is screwed into position to retain the plug in place and to compress a cable spring connected to a flexible cable enclosed in a tube. The compression of the cable spring enables a lever spring, acting oppositely to the cable spring, to move a lever attached to the cable. The lever is connected to move a trip latch that connects to a latch mechanism that opens and prevents closing of the circuit breaker.

7 Claims, 4 Drawing Figures

FIG. 1
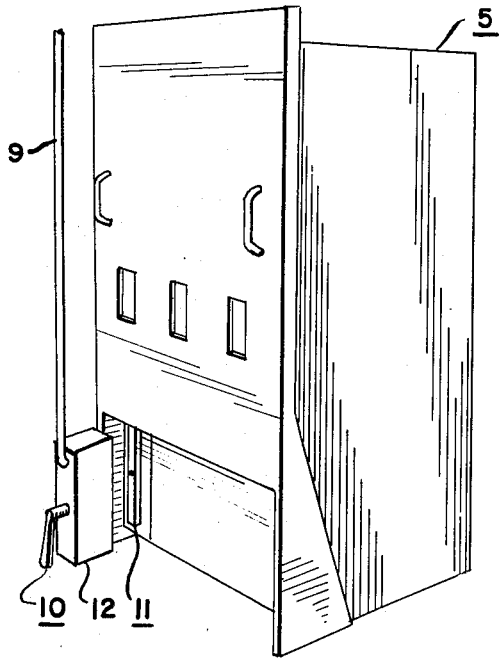
FIG. 2
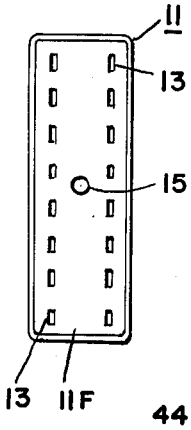
FIG. 3
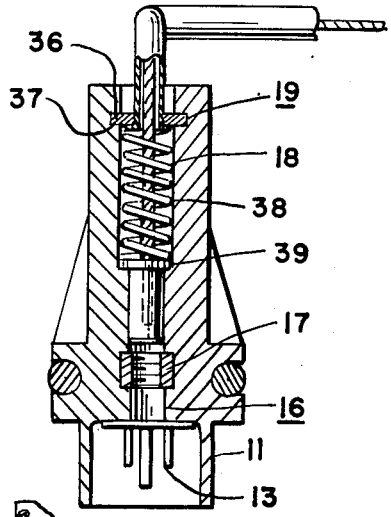
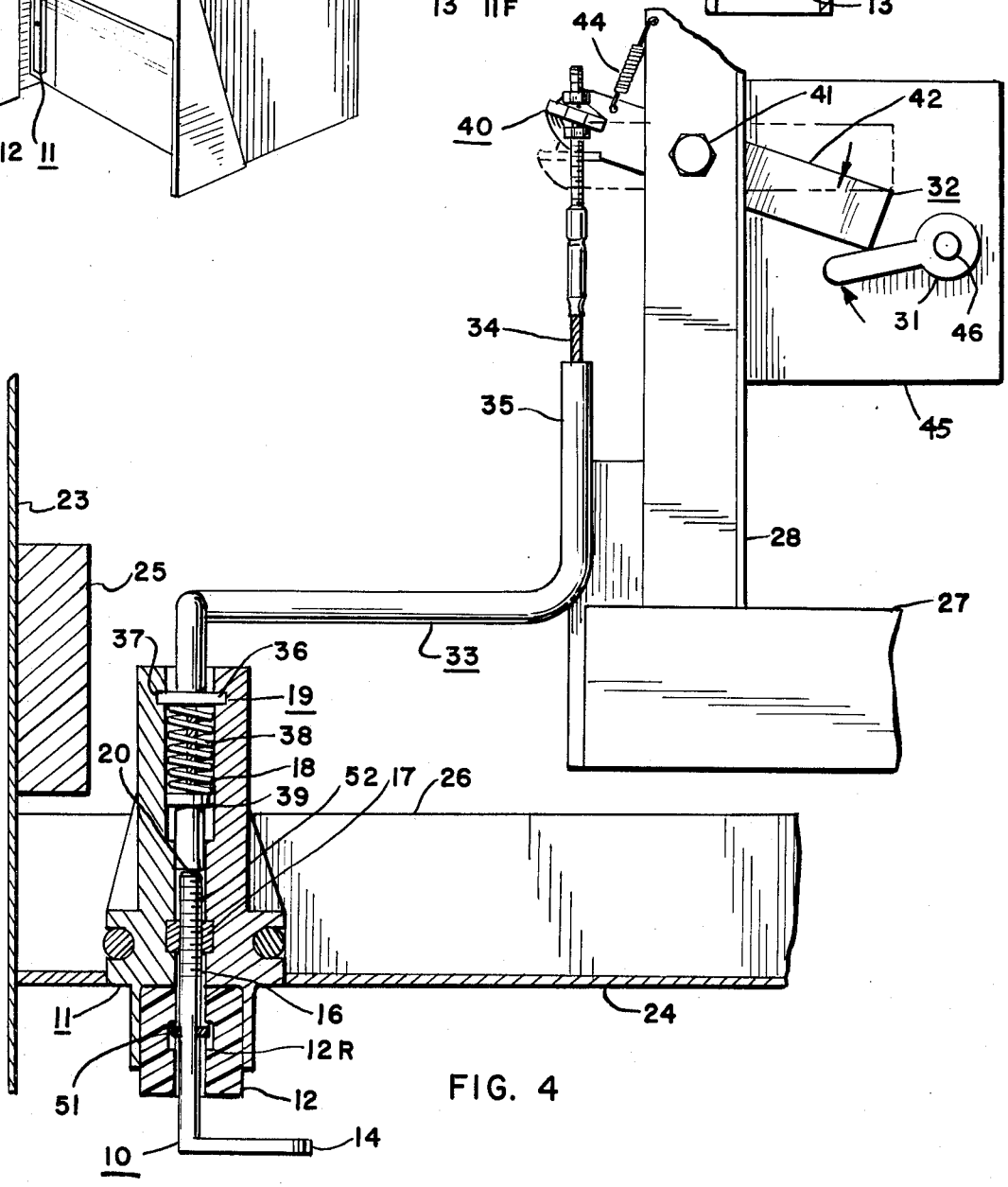
FIG. 4

INTERLOCK FOR CIRCUIT BREAKERS

BACKGROUND AND BRIEF DESCRIPTION OF THE INVENTION

This invention relates to interlocking mechanisms for circuit breakers, particularly to a mechanism that opens and prevents closing of a circuit breaker if an external control system is not connected to or is disconnected from the circuit breaker.

When a circuit breaker is controlled by an external operational control system that is connected by a conductor cable to the circuit breaker, it is essential to have the control system connected to the circuit breaker at all times to insure that the control system will function to open the circuit breaker if necessary. Since these control systems typically include over-current sensing, phase sensing, and similar functions that monitor for fault conditions, a means must be provided to insure that the electrical connection is made and functioning.

With this invention an interlocking means is provided for opening the circuit breaker when the control system is disconnected from the circuit breaker. A plug connection connects the control system to the circuit breaker and the removal of the plug moves a cable that moves an arm and operates a trip latch that indicates that the control plug is not in position on the circuit breaker. If the control plug is not connected or is removed, the trip latch position causes operation of a latch mechanism and the circuit breaker either will not operate to close or will open.

The objects and advantages of this invention will be apparent from the following description.

DESCRIPTION OF THE DRAWINGS

FIG. 1 is a simplified perspective view of a roll-in circuit breaker and a connecting line to a control system in accordance with this invention;

FIG. 2 is a view of a receptacle for the connecting plug mounted on the circuit breaker;

FIG. 3 is a cross-sectional view of the receptacle shown in FIG. 2 with the connecting plug removed; and FIG. 4 is a simplified cross-sectional bottom view of a portion of the circuit breaker shown in FIG. 1 taken through the center of the receptacle with the connecting plug in place.

DESCRIPTION OF THE PREFERRED EMBODIMENTS

Referring to FIG. 1, a roll-in medium voltage circuit breaker 5 of any type known in the art has contactors (not shown) responsive to mechanisms of any type known in the art (not shown) for opening and closing a main supply electrical power circuit. A connector means for connecting circuit breaker 5 to an external control system of any known type (not shown) comprises a connecting conductor line 9, a first connector, such as a connecting plug 12, a second, mounted connector, such as a connecting receptacle 11, adapted to receive and engage with connecting plug 12, a shaft 10, electrical contacts on plug 12 (not shown), electrical contacts 13 on receptacle 11, and an opening 15 positioned and adapted to receive shaft 10 when plug 12 is engaged with receptacle 11. Plug 12 makes electrical connections through connecting line 9 to the external control system which produces signals for controlling the operation of the circuit breaker to open and closed positions in any manner known in the art.

Referring to FIGS. 2 and 3, receptacle 11 comprises a receptacle face 11F having electrical connectors 13 arranged to receive and connect with the corresponding electrical connections on plug 12. Opening 15 in the center of face 11F receives shaft 10 when plug 12 is engaged with receptacle 11. Opening 15 comprises an internal passage 16 have a screw or threaded portion 17 and a spring chamber 18 adapted to receive a linking assembly 19, and a recess 37 adapted to receive a retaining flange 36.

Referring to FIG. 4, circuit breaker 5 has a side wall 23, a front wall 24, a support column 25, and a front support plate 26. In addition, portions of the remaining structure of the circuit breaker shown comprise a support panel 27, an L beam 28, and the linking assembly 19 which comprises a spring and cable assembly 33 having a cable 34 and a cable tube housing 35 rigidly connected to receptacle 11 by flange 36 cooperatively received in recess 37, a cable spring 38, and a cable end plug 39 connected to one end of cable 34 and positioned in opening 16, and a lever spring or operating means 44; and an arm assembly 32 having linkage 40 connected to the other end of cable 34. Arm assembly 32 has a lever arm 42 and a pivot bolt 41 mounted on L beam 28 and arm 42 is moved through linkage 40 by spring and cable assembly 33 upon a selected distance of penetration of shaft 10 into opening 15 that compresses spring 38 and enables spring 44 to move arm 42. Cable 34 is spring biased with spring 38 in one direction and biased with spring 44, connected between one end of arm 42 and L beam 28, in a opposing direction. The effective force on the cable of spring 44 is less than that of spring 38 so that spring 38 acts as disabling means for normally rendering the operating means 44 ineffective to enable closure of the circuit breaker and holds the cable in position until compressed by the insertion of the shaft to enable spring 44 to move arm 32.

A latching means for deactivating the circuit breaker is responsive to movement of linkage 40 by a selected amount that is selected to ensure that plug 12 is fully engaged with receptacle 11. The latching means comprises a trip latch 31 rigidly connected to a latch shaft 46 that is moved by arm 42 to the position shown against the bias of a spring (not shown) and a latch mechanism 45 of any type known in the art. The rotation of latch shaft 46 is transmitted to latch mechanism 45 to position a holding latch (not shown) in any manner known in the art that holds the circuit breaker in a closed position if it is moved to a closed position by a closing device (not shown). If trip latch 31 is not moved by arm 42 it returns to its biased position removing the holding latch to prevent the closing of the circuit breaker in any known manner.

Shaft 10 has a handle 14, which enables appropriate leverage or torque to be applied to shaft 10, an attached collar 51, a screw threaded portion 52, and an end portion 20. Shaft 10 is inserted into opening 15 and rotated with handle 14 to engage screw threaded portion 52 with screw thread portion 17 of opening 15 and forces collar 51 against one side of a recess 12R in plug 12 to sandwich plug connector 12 between collar 51 and receptacle connector 11 thereby forcing plug 12 into full contact engagement with receptacle 11. As shaft 10 is screwed in, end portions 20 pushes cable end plug 39 toward flange 36 to compress spring 38 and relieve the bias or spring force thereof on cable 34. This enables spring 44, which has a lesser effective force than spring 38 on cable 34, to move lever arm 42 from the dotted line position to the position shown in FIG. 4. This moves trip latch 31 to the position shown and thereby rotates shaft 46 and transmits the motion to latch mechanism 45. Thus the annular threaded portion 17, the collar 51 and the plug 39 act as control means to simultnaeously ensure full engagement of the connector contacts and control disabling spring 38 for rendering spring 44 effective to reproducibly and independently operate the latching means for enabling closure of the circuit breaker.

The proper insertion of plug 12 into receptacle 11 therefore assures that trip latch 31 is in the position shown in FIG. 4 and tht the circuit breaker is in a normal operating condition. Of shaft 14 is not in the full turned in position, trip latch 31 will be in a position that prevents closing of the circuit breaker or that causes opening of the circuit breaker if it is closed.

We claim:

1. An interlocking means for enabling the closure of a circuit breaker of the type controlled by an external control system comprising:

a first connector, a shaft, means rotatably supporting said shaft on said first connector, a second connector for engagement with said first connector and having an opening to receive the shaft for rotation in said opening when said first connector is moved relatively towards said second connector, said first and second connectors including means for establishing an electrical connection between said circuit breaker and said control system in response to the full engagement of said first connector with said second connector;

a latching means;

operating means effective for normally moving said latching means for enabling the closure of the circuit breaker;

disabling means normally effective for preventing movement of said latching means by said operating means in response to the disengagement of said shaft from said opening;

and control means operated by said shaft in response to the rotation of said shaft in said opening for moving said first connector relative said second connector to fully engage the first connector with the second connector and establish said electrical connection and for simultaneously rendering said disabling means ineffective to prevent movement of the latching means and thereby enable said operating means to independently move said latching means and enable closure of said circuit breaker.

2. An interlocking means according to claim 1 wherein said operating means comprises a first operating spring for moving said latching means to enable said closure.

said disabling means comprises a cable interconnected with said first operating spring, a second disabling spring interconnecting said second connector with said cable to bias the cable for movement in one direction opposing the bias of said first spring, said second disabling spring of a greater effective spring force than said first operating spring, whereby said first operating spring is prevented from moving said latching means said second disabling spring positioned in the opening, said control means includes a plug in said opening engaged by the rotated shaft to counteract the bias of said second disabling spring on the cable whereby the latching means is moved by the first operating spring.

3. An interlocking means according to claim 2 wherein said second connector includes a connector block in which said opening is formed having an annular screw thread portion therein, said shaft has a screw thread engaging the screw thread portion of the opening upon rotation of the shaft in said opening to move said shaft in one axial direction along the shaft axis, and said control means for moving said first connector includes a retaining collar moved with said shaft in said one axial direction to move said first connector in said one axial direction to full engagement with said second connector upon the movement of said shaft through a selected distance corresponding to a predetermined angular rotation of said shaft screw thread relative to said opening annular screw thread portion.

4. An interlocking means according to claim 3 wherein said latching means comprises a trip latch and said operating means comprises a support having one portion of said first operating spring secured thereto, a lever arm, means pivotally mounting said lever arm on said support with another portion of said first operating spring secured to said lever arm for moving said lever arm to move said trip latch, and one end portion of said cable is connected to said lever and another end portion of said cable is connected to said second disabling spring to move said lever arm from said trip latch, said second disabling spring located in said opening for compression by said shaft in response to the rotational movement of said shaft.

5. An interlocking means according to claim 1 wherein said second connector includes a connector block in which said opening is formed and said control means includes an annular screw threaded portion in said opening, a screw thread on said shaft engaging the annular screw threaded portion for moving said shaft axially relative said annular screw threaded portion in response to rotational movement of said shaft in said opening, and a retaining collar carried by said shaft and engaged with said first connector to move said first connector relative to said second connector in response to said rotational movement of said shaft.

6. An interlocking means for preventing closure of a circuit breaker of the type controlled by an external control system in response to the disconnection of said external control system and for enabling closure of said circuit breaker in response to the connection of said control system comprising:

a first connector having an electrical contact, a screw threaded shaft, means rotatably supporting said shaft on said first connector, a second connector on said circuit breaker adapted to receive the first connector and having an electrical contact to establish an electrical connection between said circuit breaker and said control system in response to the engagement of said contacts, said second connector having a passage for rotatably receiving said shaft, an annular screw threaded portion in said passage adapted to engage the screw thread of said shaft when said shaft is rotatably received in said passage for moving said shaft in one axial direction, a retaining collar on said shaft sandwiching first said connector between said collar and said second connector to force the contacts into engagement when said shaft is moved in said one axial direction in response to the rotational engagement of the shaft screw thread with said annular screw threaded portion;

a cable having one end positioned in said passage for movement in said one axial direction by the shaft in response to said rotational engagement, a first disabling spring in said passage and secured to said one cable end, means in said passage seating said spring to bias the one end of the cable longitudinally toward said shaft whereby the bias of said disabling spring is relieved in response to the movement of said shaft in said one axial direction, a support, a second operating spring of a lesser effective spring force on the cable than said disabling spring connected between said cable and said support to bias the cable in a longitudinal direction opposite to that of the first disabling spring, said operating spring bias rendered effective to move said cable in response to the relief of said disabling spring bias;

an arm connected to said cable other end and to said operating spring, means pivotally supporting said arm on said support for movement in one arcuate direction in response to the bias of said disabling spring on said cable and in the opposite arcuate direction by said operating spring in response to the relief of said disabling spring bias; and a trip latch arranged for movement by the arm in response to movement of said arm in said opposite arcuate direction for moving said trip latch to enable said circuit breaker and movable in the other direction in response to movement of said arm in said one arcuate direction for disabling said circuit breaker.

7. The interlocking means claimed in claim 1 in which said shaft has a handle extending therefrom for applying a torque to said shaft.

* * * * *

UNITED STATES PATENT AND TRADEMARK OFFICE

CERTIFICATE OF CORRECTION

PATENT NO. : 4,041,260

DATED : August 9, 1977

INVENTOR(S) : David L. Swindler and Donald I. Dykes

It is certified that error appears in the above-identified patent and that said Letters Patent are hereby corrected as shown below:

Col. 3, line 56, change "closure." to --closure,--

Col. 4, line 27, insert "arm" after --lever--

Col. 6, line 18, insert "radially" after --extending--

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*